United States Patent [19]

Polonsky et al.

[11] 4,226,497

[45] Oct. 7, 1980

[54] BATTERY TERMINAL HARNESS HAVING IMPROVED FASTENING MEANS FOR PREVENTING APPLICATION OF REVERSE POLARITY VOLTAGE

[75] Inventors: Samuel Polonsky, Monroe; Edward V. Pomponio, Beacon Falls, both of Conn.

[73] Assignee: General Electric Company, New York, N.Y.

[21] Appl. No.: 1,550

[22] Filed: Jan. 8, 1979

[51] Int. Cl.[3] ..... H01R 13/64

[52] U.S. Cl. ..... 339/184 M; 339/105; 339/256 RT; 429/1

[58] Field of Search ..... 429/1, 121; 339/184 R, 339/154 R, 105, 116 R, 258 R, 258 T, 258 TC, 228–237, 152, 256 RT, 128, 184 M; 46/45, 228, 248

[56] References Cited

U.S. PATENT DOCUMENTS

| | | | |
|---|---|---|---|
| 1,277,071 | 8/1918 | Hastings et al. | 339/184 R |
| 2,989,722 | 6/1961 | O'Donnell | 339/184 R X |
| 3,980,388 | 9/1976 | Nailor | 339/184 R X |
| 4,024,953 | 5/1977 | Nailor | 339/228 X |
| 4,084,037 | 4/1978 | Morton | 429/1 |

FOREIGN PATENT DOCUMENTS

| | | | |
|---|---|---|---|
| 560973 | 4/1975 | Switzerland | 421/1 |

*Primary Examiner*—Roy Lake
*Assistant Examiner*—Eugene F. Desmond
*Attorney, Agent, or Firm*—George R. Powers; Leonard J. Platt; John F. Cullen

[57] ABSTRACT

A battery terminal harness for connection with a predetermined polarity to the dissimilar terminals of a battery is provided with insulating cover means for preventing inadvertent short-term reverse polarity contact between the battery terminals and the connectors of the harness. Fastening means are provided for securing the cover means to a support member, the fastening means including aligned openings in a tab to the cover member and the support member and securing means passing through the aligned openings.

4 Claims, 5 Drawing Figures

BATTERY TERMINAL HARNESS HAVING IMPROVED FASTENING MEANS FOR PREVENTING APPLICATION OF REVERSE POLARITY VOLTAGE

BACKGROUND OF THE INVENTION

1. Field of the Invention

This invention relates to a battery terminal harness and, more particularly, to one insulated battery terminal harness having improved fastening means preventing the application of reverse polarity voltage to a circuit connected to the harness.

2. Description of the Prior Art

For proper operating, many battery-operated electrical circuits, including virtually all electronic circuits, must be connected to the battery with a particular polarity. In other words, the "positive" polarity input terminal to the circuit must be connected to the positive or plus terminal of the battery, and the "negative" polarity input terminal to the circuit must be connected to the negative or minus terminal of the battery. To assure the proper polarity connections, it is common to use batteries having dissimilar terminals and battery terminal harnesses having mating dissimilar terminal connectors. By connecting the harness to the electrical circuit in the desired manner, the person using the circuit can be assured that the battery is connected to the circuit with the correct polarity since the battery terminals and the terminal connectors will mate with only the desired polarity. Nevertheless, it has been found that reverse voltage can be applied to the circuit if the harness connectors are inadvertently pressed against the battery terminals in reverse orientation. While the battery terminals will not mate with the harness connectors in the reverse orientation, the short-term reverse voltage applied to the circuit in this manner may damage or lessen the reliability of the circuit. Accordingly, it has heretofore been common to protect the circuit against the application of short-term reverse voltage by means of an appropriate diode or other one-way protective device. This approach is not always desirable, however, since such protective elements may introduce operating deficiencies or excess cost.

U.S. Pat. application Ser. No. 3,419 for "Battery Terminal Harness for Preventing Application of Reverse Polarity Voltage", filled concurrently herewith by Harry Albinger, Jr., and Kenneth E. House and assigned to General Electric Company, provides an inexpensive and effective means for preventing the inadvertent application of short-term reverse voltage. More particularly, the above-identified patent application teaches the use of an insulating cover member on the battery terminal harness for preventing unwanted contact between one of the terminal connectors and the non-mating battery terminal. The insulating cover member of the above-identified patent application snaps into position on the harness, and it has been found in practice that the cover may become dislodged if not handled with reasonable care. As a result, there is a possibility that the cover can come off of the harness, and, if the cover is not replaced, reverse voltage can again be applied to the harness and any circuit connected thereto.

SUMMARY OF THE INVENTION

It is therefore a primary object of this invention to provide improved fastening means for assuring that the cover member for preventing the application of reverse voltage to a battery-operating electrical circuit does not become dislodged.

Another object of the invention is to provide the above object in an inexpensive manner.

A still further object of the invention is to provide the above objects in a manner not requiring additional elements or additional labor.

Briefly stated, in carrying out the invention in one form, a battery terminal harness is provided for connection to a battery having a first terminal connected to a first polarity of the battery and a second terminal connected to a second polarity of the battery, the second terminal having at least one dimension substantially larger than the corresponding dimension of the first terminal. The battery terminal harness includes an insulating support member having an opening therein, a first terminal connector mounted on the support member and adapted to electrically mate with the first battery terminal, and a second terminal connector mounted on the support member and adapted to electrically mate with the second battery terminal. An insulating cover member having an opening therein covers the first terminal connector, the configuration of the opening being such that the first terminal of the battery is sufficiently small to pass through the opening while the second terminal of the battery is too large to pass through the opening. In this manner, the cover member prevents inadvertent contact between the second battery terminal and the first terminal connector. As a result, it is impossible to inadvertently apply reverse voltage to an electrical circuit connected to the battery terminal harness. To maintain the cover member firmly in position, fastening means are provided in accordance with the invention. The fastening means includes a tab member connected to the cover member and extending across the opening in the support member. The tab member has an opening therein aligned with the opening in the support member when the cover member is covering the first terminal connector. Securing means extend through the aligned openings in the tab member and the support member to secure the cover member in position over the first terminal.

In accordance with further aspects of the invention, electrical leads connected to the first and second terminal connectors pass through the aligned openings in the tab member and the support member to form the securing means. Also in accordance with a further aspect of the invention, the fastening means further comprises an extension of the cover member diametrically opposed to the tab member, the extension comprising means for engaging the insulating support member. The cover member, the extension of the cover member, and the tab member are preferably integrally formed of plastic material.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in connection with the drawing in which:

DETAILED DESCRIPTION

Figure 1:
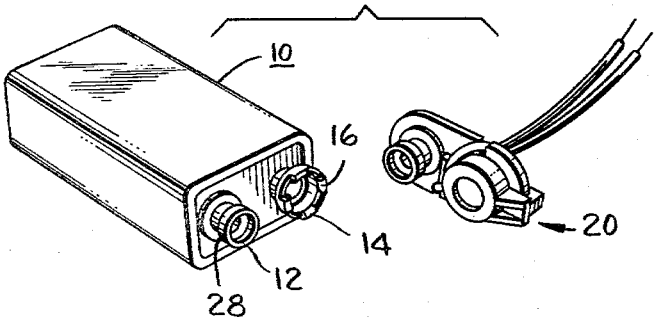
FIG. 1 is a view of a typical 9-volt battery having dissimilar terminals and a battery terminal harness constructed in accordance with the present invention.

Referring first to FIG. 1, a typical 9-volt battery 10 of the type widely used to power electronic circuits is illustrated, the battery 10 having dissimilar positive and negative terminals 12 and 14, respectively. As illustrated by FIG. 1, the positive terminal 12 is of cylindrical stud configuration and the negative terminal 14 is of annular resilient configuration for peripherally engaging a cylindrical stud member having substantially the same configuration as the positive terminal 12. More particularly, the negative terminal 14 is of general cylindrical configuration with axially extending, radially resilient fingers 16 for radially engaging the outer cylindrical surface of a stud member. The axes of the positive and negative terminals 12 and 14 are typically spaced apart by approximately one-half inch in typical 9-volt batteries such as alkaline battery No. MN1604 available from P. R. Mallory and Co.

Figure 5:
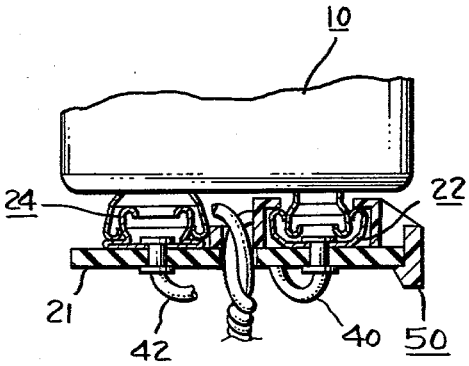
FIG. 5 is a view showing the battery terminal harness of the invention connected to a 9-volt battery of the type shown by FIG. 1.

A battery terminal harness 20 as illustrated by FIGS. 1–5 includes an insulating support member 21 of fiberboard or other insulating material upon one side of which a first terminal connector 22 and a second terminal connector 24 are mounted. The first terminal connector 22 has substantially the same configuration as that of the negative battery terminal 14 such that the positive battery terminal 12 can be snapped into the connector 22, the fingers 26 of the connector 22 resiliently engaging the outer cylindrical surface 28 of the terminals 12. Similarly, the second terminal connector 24 for substantially the same configuration as that of the positive battery terminal 12 such that the negative battery terminal 14 can be snapped over the connector 24, the fingers 16 of the terminal 14 resiliently engaging the outer cylindrical surface 30 of the connector 24. The axes of the connectors 22 and 24 are spaced apart by substantially the same amount as the terminals 12 and 14 such that the terminals 12 and 14 may be simultaneously engaged with the connectors 22 and 24, respectively, as best shown by FIG. 5. The resilient connections between the terminals and the terminal connectors assures that the battery terminal harness 20 is firmly held on the battery 10.

Figure 3:
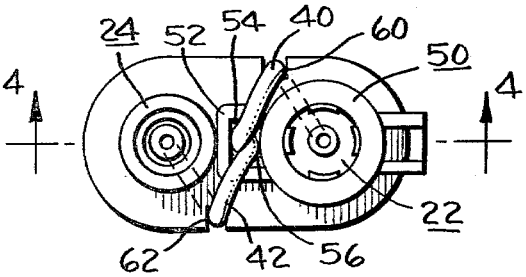
FIG. 3 is a plane view of the battery terminal harness of FIG. 1 taken along viewing line 3—3 of FIG. 4.
Figure 4:
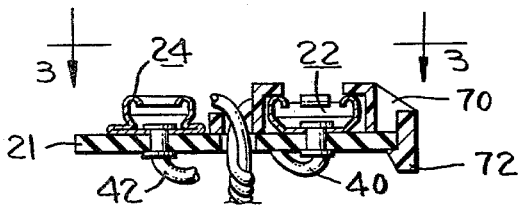
FIG. 4 is an elevation view of the battery terminal harness of FIG. 1 taken along viewing line 4—4 of FIG. 3.

As best shown by FIGS. 3 and 4, the terminal connector 22 is connected to an electrical lead 40 which comes out of the opposite side of the insulating support member 21, and the terminal connector 24 is connected to an electrical lead 42 which also comes out of the opposite side of the insulating support members 21. Since the connector 22 can only mate with the positive battery terminal 12, the lead 40 is the positive lead to any circuit connected to the battery terminal harness 20. Similarly, since the connector 24 can only mate with the negative battery terminal 14, the lead 42 is the negative lead to any circuit connected to the battery terminal harness 20.

A cover member 50 is provided for assuring that reverse voltage cannot be applied to the leads 40 and 42 and any circuit connected thereto. Reverse polarity voltage could be applied if the terminal 12 and the connector 24 were touched and the terminal 14 and the connector 22 were touched at the same time. Even though the harness 20 could not be snapped onto the battery 10 under these conditions, the short-term reverse voltage could cause failure or reduced life of many circuits normally powered in the illustrated manner.

As shown, the cover member 50 forms a cup over the terminal connector 22. The cover member 50 has a circular opening therein centered above the connector 22, the diameter of the opening being large enough to permit the battery terminal 12 to pass therethrough to mate with the connector 22. The diameter of the opening is, however, less than that of the connector 22 and the terminal 14. As a result, the connector 22 and the terminal 14 cannot be inadvertently touched together and reverse polarity voltage cannot be applied to a circuit connected to the leads 40 and 42.

Figure 2:
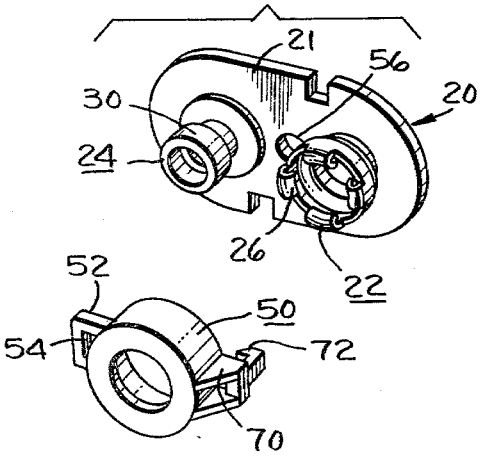
FIG. 2 is an exploded view of the battery terminal harness of FIG. 1.

In accordance with the invention and as shown by FIGS. 2–4, improved fastening means are provided for securing the cover member 50 in position over the terminal connector 22. The fastening means of the invention includes a tab member 52 connected to the cover member 50 such that the tab member 52 extends across the upper face of the support member 21 toward the connector 24 when the cover member is placed in position over the connector 22. The tab member 52 has an opening 54 therein which overlies an opening 56 in the support member 21. To secure the cover member 50 in position, the electrical leads 40 and 42 are passed through the aligned openings 54 and 56 to tie the cover 50 down to the support member 21. More particularly, the lead 40 from the other side of the support member 21 is passed through an edge notch 60 in the edge of the support member 21 to the upper side thereof, and the lead 42 is passed through an edge notch 62 in the edge of the support member 21 to the upper side thereof. From the upper side, the two leads 40 and 42 are passed through the aligned openings 54 and 56 to the other side of the support member 21, where the leads are twisted together. This arrangement not only ties the cover member 50 down to the support member 21, but also provides strain relief for the electrical connections between the leads 40 and 42 and the respective terminal connectors 22 and 24.

To still more securely tie down the cover member 50, the cover member 50 is provided with an extension 70 diametrically opposed to the tab member 52, the extension 70 having a relatively rigid depending hook portion 72 which extends around the end of the support member 21. The combination of the tie-down arrangement by the leads 40 and 42 at the center of the harness 20 and the snap connection at the end of the harness securely locks the cover member 50 in position. The cover member 50, the extension 70 of the cover member, and the tab member 52 are preferably formed integrally of an insulating plastic material.

From the foregoing, it will be seen that this invention provides improved fastening means for assuring that the cover member for preventing the application of source voltage does not become dislodged. The improved fastening means provides the desired securing of the cover member in an inexpensive manner not requiring additional elements or assembly labor.

While the invention has been particularly shown and described with reference to a preferred embodiment thereof, it will be understood by those skilled in the art that various changes in form, details, and application may be made therein without details, and application may be made therein without departing from the spirit and scope of the invention. Accordingly, it is intended that all such modifications and changes be included within the scope of the appended claims.

What is claimed as new and is desired to secure by Letters Patent of the United States is:

1. An improved battery terminal harness for connection to a battery having a first terminal coupled to a first polarity of the battery and a second terminal coupled to a second polarity of the battery, the second terminal having at least one dimension substantially larger than the corresponding dimension of the first terminal, said improved battery terminal harness comprising:

an insulating support member having an opening therein;

a first terminal connector mounted on said support member and adapted to electrically mate with the first terminal of a battery;

a second terminal connector mounted on said support member and adapted to electrically mate with the second terminal of a battery;

an insulating cover member covering said first terminal connector, said cover member having an opening therein, the configuration of said opening in said cover member being such that the first terminal of the battery is sufficiently small to pass therethrough to mate with the first terminal connector and the second terminal of the battery is too large to pass therethrough to contact said first terminal connector; and fastening means comprising:

a tab member connected to said cover member and extending across said opening in said support member, said tab member having an opening therein aligned with said opening in said support member when said cover member is covering said first terminal connector, and electrical leads connected to said first and second terminal connectors and passing through said aligned openings in said tab member and said support member to secure said cover member in position over said first terminal connector;

whereby inadvertent reverse polarity contact of said battery terminal harness to the battery terminals is prevented.

2. An improved battery terminal harness as defined by claim 1 in which said fastening means further comprises an extension of said cover member diametrically opposed to said tab member, said extension of said cover member comprising means for engaging said insulating support member.

3. An improved battery terminal harness for connection to a battery having a first terminal of cylindrical stud configuration coupled to a first polarity of the battery and a second terminal coupled to a second polarity of the battery, the second terminal being of annular resilient configuration for peripherally engaging a cylindrical stud member having substantially the configuration of the first terminal, said improved battery terminal harness comprising:

an insulating support member having an opening therein;

a first terminal connector mounted on said support member and having substantially the configuration of the second terminal for electrically mating with the first terminal of a battery;

a second terminal connector mounted on said support member and having substantially the configuration of the first terminal for electrically mating with the second terminal of a battery;

an insulating cover member covering said first terminal connector, said cover member having a circular opening therein sufficiently large to pass the first terminal of the battery and too small to pass the second terminal of the battery; and fastening means comprising:

a tab member connected to said cover member and extending across said opening in said support member, said tab member having an opening therein aligned with said opening in said support member when said cover member is covering said first terminal connector, and electrical leads connected to said first and second terminal connectors and passing through said aligned openings in said tab member and said support member to secure said cover member in position over said first terminal connector;

whereby inadvertent reverse polarity contact of said battery terminal harness to the battery terminals is prevented.

4. An improved battery terminal harness as defined by claim 3 in which said fastening means further comprises an extension of said cover members diametrically opposed to said tab member, said extension of said cover member comprising resilient means for engaging said insulating support member.

* * * * *